US007676050B2

(12) United States Patent
Sauer

(10) Patent No.: US 7,676,050 B2
(45) Date of Patent: Mar. 9, 2010

(54) COVER FIXTURE FOR AT LEAST ONE MICROPHONE INPUT OF A HEARING DEVICE

(75) Inventor: Joseph Sauer, Strullendorf (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1034 days.

(21) Appl. No.: 11/373,697

(22) Filed: Mar. 10, 2006

(65) Prior Publication Data

US 2006/0215863 A1 Sep. 28, 2006

(30) Foreign Application Priority Data

Mar. 16, 2005 (DE) ..... 10 2005 012 149

(51) Int. Cl.
*H04R 25/00* (2006.01)

(52) U.S. Cl. ..... 381/324; 381/322; 381/330

(58) Field of Classification Search ..... 381/322, 381/324, 327–328, 330, 381
See application file for complete search history.

(56) References Cited

U.S. PATENT DOCUMENTS 3,045,073 A * 7/1962 Vickerson ..... 381/330
3,876,843 A * 4/1975 Moen ..... 381/330
4,987,597 A 1/1991 Haertl
6,574,343 B1 6/2003 Meier

FOREIGN PATENT DOCUMENTS

| | | | |
|---|---|---|---|
| DE | 1153797 | | 9/1963 |
| DE | 20208601 | U1 | 11/2003 |
| EP | 0 310 866 | B1 | 4/1989 |
| EP | 0337195 | A2 | 10/1989 |
| EP | 0847227 | A2 | 6/1998 |
| EP | 1439733 | A1 | 7/2004 |
| JP | 08251698 | A | 9/1996 |

* cited by examiner

*Primary Examiner*—Suhan Ni

(57) ABSTRACT

Protective facilities in microphone inputs of a hearing device should be able to be exchanged in a more user-friendly manner. For this purpose, provision is made for a cover fixture for at least one microphone input of a hearing device with an essentially acoustically permeable protective facility to protect the at least one microphone input against solid particles. The cover fixture can be fixed to the surface of the hearing device in a friction-fitted or form-fitted manner. The cover fixture can however also be designed in one piece with the upper shell of the hearing device.

6 Claims, 1 Drawing Sheet

COVER FIXTURE FOR AT LEAST ONE MICROPHONE INPUT OF A HEARING DEVICE

CROSS REFERENCE TO RELATED APPLICATIONS

This application claims priority to the German Application No. 10 2005 012 149.7, filed Mar. 16, 2005 which is incorporated by reference herein in its entirety.

FIELD OF INVENTION

The present invention relates to a cover fixture for at least one microphone input of a hearing device with an essentially acoustically permeable protective facility to protect the at least one microphone input against solid particles.

BACKGROUND OF INVENTION

Hearing aid equipment and in particular behind-the-ear hearing devices and in-the-ear hearing devices are naturally compromised by contamination. The microphones or microphone inputs, if applicable, are primarily affected by the possible contaminations.

Contamination of the microphones of hearing devices generally leads to device failures, which frequently results in very expensive repairs.

SUMMARY OF INVENTION

To avoid contaminating microphone inputs as far as possible, a number of corresponding precautionary measures are taken. The microphone inputs are covered with grids or films for instance, so that dirt particles cannot reach, or only reach the microphone to a reduced degree. The films and grids are generally fixed to the hearing device shell and can only be changed by an acoustician. This is not user-friendly for hearing aid wearers, thereby causing protective facilities to be frequently removed without replacement. Device failures are thus preprogrammed and high degrees of damage result for the hearing device manufacturer, particularly during the warranty period.

Publication EP 0 310 866 B1 discloses a device for sealing openings on hearing devices or ear pieces for hearing devices. The in-the-ear hearing device displayed in more detail here comprises a housing with a front cover. A battery compartment can be rotated out of the hearing device by means of a cover on the front cover. A sound inlet aperture for the microphone is located in the front cover. A snap-on cap comprising a membrane for sealing against earwax and sweat is positioned on this sound inlet aperture.

An object of the present invention is thus to provide a user-friendly exchangeable protection for microphone inputs of a hearing device.

This object is achieved according to the invention by a cover fixture for at least one microphone input of a hearing device with an essentially acoustically permeable protective facility for protecting the at least one microphone input against solid particles and a carrier facility which can be fixed to the surface of a housing of a behind-the-ear hearing device in a friction-fitted or form-fitted manner, and which supports the protective facility.

Advantageously, a carrier facility or a hearing device housing segment, which supports a protective film as a protective facility for instance, can be managed better than the protective film for the small microphone input itself. The protective facility can thus be more easily exchanged if necessary.

The protective facility preferably features the already mentioned protective film and/or a non-woven material, a grid and/or a filter. This allows the different types of contamination to counteract each other in a suitable manner.

The cover fixture according to the invention can be connected to a battery compartment cover in one piece. The protective facility can thus be exchanged by a simple exchange of the battery compartment cover.

According to a particularly preferred embodiment, the carrier facility is designed as a clasp, which can at least partially embrace a segment of a hearing device, so that the carrier facility can be clasped or plugged onto the hearing device housing. A clasp-shaped carrier facility of this type allows the protective facility for one or a number of microphone inputs to be easily detached from the hearing device and reattached.

If a hearing device is provided with a cover fixture as described above, it is favorable for the cover fixture to feature an electrical contact, so that an electrical connection of the hearing device electronics can be established by the inbuilt cover fixture. By way of example, this ensures that the hearing device can only be operated if the cover fixture is attached to the specified position on the hearing device.

BRIEF DESCRIPTION OF THE DRAWINGS

The present invention is now described in more detail with reference to the appended drawings, in which.

The exemplary embodiments shown in more detail below represent preferred embodiments of the present invention.

DETAILED DESCRIPTION OF INVENTION

Figure 1:
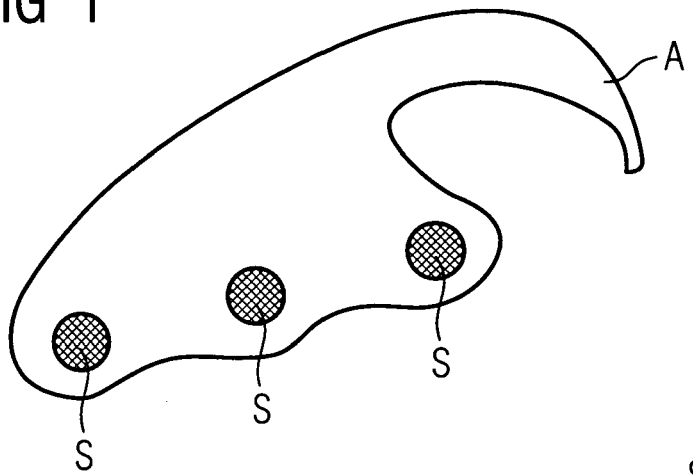
FIG. 1 shows a schematic view of a clasp-shaped, inventive cover fixture.

According to a first embodiment, as shown in FIG. 1, a cover fixture A according to the invention is configured in the form of a clasp. The cover fixture serves to protect three microphones of a hearing device (not shown). Correspondingly it comprises three protective facilities S, which are symbolized in FIG. 1 by circular grids. These protective facilities S can also be implemented by membranes or protective films, non-woven material, filters or the like.

Figure 2:
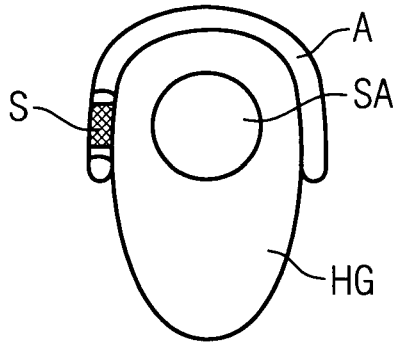
FIG. 2 shows the cover fixture of FIG. 1 attached to the hearing device.

In an attached state, the clasp-shaped cover fixture A embraces the hearing device HG to such an extent that an adequately firm fit is ensured by the clasping force and the molding of the cover fixture A as well as the hearing device HG. In FIG. 2, the cover fixture A is displayed in an inbuilt state or attached state. The hearing device HG is hereby reproduced by the side of the sound tube connection SA. The protective facility S is shown here in the form of a non-woven material of a specific thickness.

The individual protective facilities can be more easily managed due to the fact that the small protective facilities S are integrated in a large clasp or cover fixture. The exchange of the protective facilities S does not require the housing of the hearing device HG to be opened.

Figure 3:
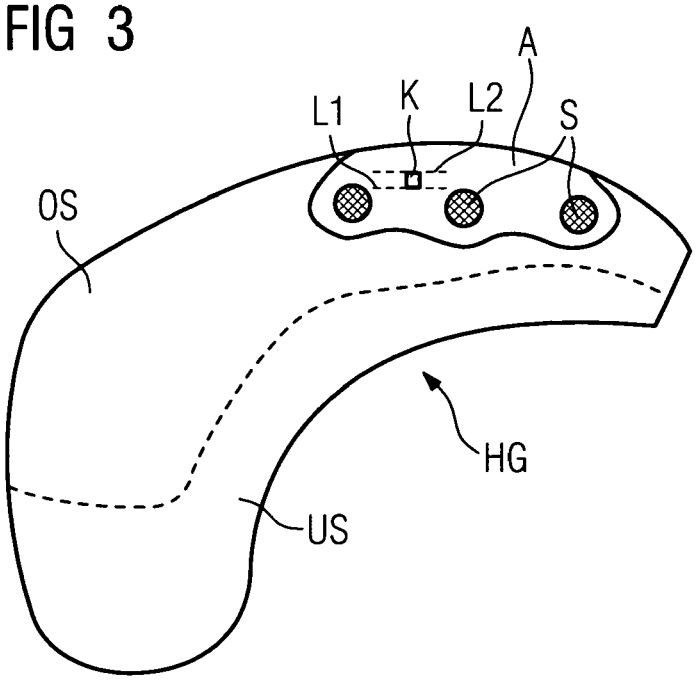
FIG. 3 shows the cover fixture of FIG. 1, which is fitted flush with a hearing device shell.

For cosmetic reasons, a recess can be provided in the shell of the hearing device HG according to FIG. 3, so that the cover fixture A including the protective facilities S can be clasped or clamped to the hearing device HG flush with the surface of the hearing device shell.

Figure 4:
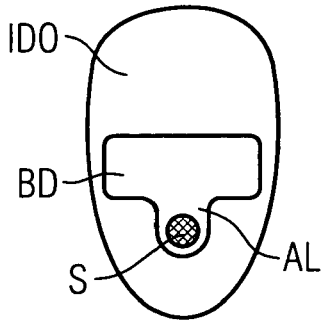
FIG. 4 shows a cover fixture, which is configured in one-piece with a battery compartment cover.

With in-the-ear hearing devices, the microphone opening is typically arranged adjacent to the battery compartment, as can be seen in FIG. 4. In many cases, the battery compartment covers are thus provided with a cantilever which covers the microphone opening by forming a gap. However, as this cantilever can perform natural oscillations, this can lead to a typical buzzing as a result of feedback. With correspondingly high feedback, the oscillation amplitudes of the cantilever are so great that the cantilever hammers on the edge of the microphone opening and thus generates a flapping noise which is notedly disturbing for the hearing device wearer. An acoustically permeable protective facility S is thus arranged in the cantilever AL of the battery compartment cover BD of the hearing device ITE. In this way, the cantilever AL can lie flush with the edge of the microphone input, so that oscillations of the cantilever and corresponding noise developments by feedback can be avoided. The protective facility S is thus configured as those set down in the preceding exemplary embodiments.

As it is notedly important for the lifespan of the hearing device that the microphone inputs are protected by protective facilities S, it is advantageous for the hearing device to then be operated only when the protective facilities S are arranged in front of the microphone inputs. A power supply conductor L1, L2 (cf. FIG. 3) can thus be routed below the cover fixture A to the surface of the hearing device. The two conductor segments L1 and L2 are separated from one another. A contact K of the cover fixture A only links the two conductor segments L1 and L2 when the cover fixture A is attached to the hearing device in a specified position, thereby ensuring the power supply of the hearing device HG. During operation of the hearing device, the hearing device wearer is thus always obliged to clasp or clamp the cover fixture A including the protective facility S in front of the microphone inputs.

The invention claimed is:

1. A cover fixture for at least one microphone input of a hearing device, comprising:

an acoustically permeable protective facility for protecting the at least one microphone input against solid particles; and a carrier facility for supporting the protective facility, the carrier facility configured to be connected to a surface of a housing of a behind-the-ear hearing device;

wherein the cover fixture is connected to a battery compartment cover, the cover fixture and the battery compartment cover forming one piece;

and wherein the carrier facility is a clasp configured to at least partially embrace a segment of the hearing device such that the carrier facility can be clasped to the housing.

2. The cover fixture according to claim 1, wherein the protective facility comprises a protective film, a non-woven material, a grid or a filter.

3. A behind-the-ear hearing device, comprising a cover fixture for at least one microphone input of a hearing device, the cover fixture comprising:

an acoustically permeable protective facility for protecting the at least one microphone input against solid particles; and a carrier facility for supporting the protective facility, the carrier facility configured to be connected to a surface of a housing of the behind-the-ear hearing device;

wherein the cover fixture is connected to a battery compartment cover, the cover fixture and the battery compartment cover forming one piece;

and wherein the carrier facility is a clasp configured to at least partially embrace a segment of the hearing device such that the carrier facility can be clasped to the housing.

4. The hearing device according to claim 3, wherein the cover fixture comprises an electrical contact for short-circuiting two conductor segments of hearing device electronics when the cover fixture is installed.

5. The hearing device according to claim 1, wherein said clasp is configured to embrace the hearing device in an attached state in which a clasping force is formed between a molding of the clasp and an outer shell of the hearing device.

6. The hearing device according to claim 1, wherein said protective facility is positioned in a cantilever of the battery compartment cover, and wherein said cantilever is positioned flush with the edge of the microphone input, to minimize oscillation of the cantilever.

* * * * *